US006869354B2

(12) United States Patent
Lipinski et al.

(10) Patent No.: US 6,869,354 B2
(45) Date of Patent: Mar. 22, 2005

(54) ZERO COOLING AIR FLOW OVERFIRE AIR INJECTOR AND RELATED METHOD

(75) Inventors: William T. Lipinski, Canton, OH (US); Peter V. Centore, Louisville, OH (US); George M. Gorring, Massillon, OH (US); James J. Jennings, Barberton, OH (US); Robert Waltz, Canton, OH (US); Thomas A. Laursen, Canton, OH (US); Chris E. Latham, Homeworth, OH (US); Duane Plessinger, Wooster, OH (US); Don Morrison, Clinton, OH (US); David O'Connor, Roswell, GA (US)

(73) Assignee: General Electric Company, Schenectady, NY (US)

( * ) Notice: Subject to any disclaimer, the term of this patent is extended or adjusted under 35 U.S.C. 154(b) by 2 days.

(21) Appl. No.: 10/307,471

(22) Filed: Dec. 2, 2002

(65) Prior Publication Data

US 2004/0106077 A1 Jun. 3, 2004

(51) Int. Cl.[7] ..... F24F 7/00
(52) U.S. Cl. ..... 454/361; 454/363; 431/12
(58) Field of Search ..... 454/358, 361, 454/363; 431/10, 12, 20

(56) References Cited

U.S. PATENT DOCUMENTS

| | | | | | |
|---|---|---|---|---|---|
| 3,275,031 | A | * | 9/1966 | Alyea et al. | 137/601.06 |
| 3,783,768 | A | * | 1/1974 | Caming et al. | 454/335 |
| 4,050,628 | A | * | 9/1977 | Konnerth, III | 237/55 |
| 4,080,909 | A | | 3/1978 | Nalbandian et al. | |
| 4,182,487 | A | * | 1/1980 | Eriksson | 236/49.5 |
| 4,245,779 | A | * | 1/1981 | Ardiente | 236/1 G |
| 4,377,134 | A | | 3/1983 | Frey | |
| 4,403,941 | A | * | 9/1983 | Okiura et al. | 431/10 |
| 4,511,325 | A | * | 4/1985 | Voorheis | 431/10 |
| 4,957,050 | A | * | 9/1990 | Ho | 110/346 |
| 5,161,471 | A | | 11/1992 | Piekos | |
| 5,195,450 | A | | 3/1993 | Marion | |
| 5,343,820 | A | | 9/1994 | Marion | |
| 5,728,001 | A | * | 3/1998 | Attridge, Jr. | 454/369 |
| 5,756,059 | A | | 5/1998 | Zamansky et al. | |
| 5,899,172 | A | | 5/1999 | Dallen et al. | |
| 5,915,310 | A | | 6/1999 | Hura et al. | |
| 5,944,506 | A | * | 8/1999 | Kamal et al. | 431/159 |
| 6,030,204 | A | | 2/2000 | Breen et al. | |
| 6,048,510 | A | | 4/2000 | Zauderer | |
| 6,058,855 | A | | 5/2000 | Ake et al. | |
| 6,206,685 | B1 | | 3/2001 | Zamansky et al. | |
| 6,206,687 | B1 | * | 3/2001 | Redington | 431/90 |
| 6,244,200 | B1 | * | 6/2001 | Rabovitser et al. | 110/347 |
| 6,280,695 | B1 | | 8/2001 | Lissianski et al. | |
| 6,318,277 | B1 | | 11/2001 | Kokkinos | |
| 6,325,002 | B1 | | 12/2001 | Ashworth | |
| 6,471,506 | B1 | | 10/2002 | Zamansky et al. | |
| 6,474,271 | B1 | | 11/2002 | Widmer et al. | |
| 6,497,187 | B2 | | 12/2002 | Khinkis et al. | |
| 6,497,230 | B1 | * | 12/2002 | Higgins et al. | 126/285 R |

* cited by examiner

*Primary Examiner*—Derek S. Boles
(74) *Attorney, Agent, or Firm*—Nixon & Vanderhye P.C.

(57) ABSTRACT

A damper box for an orifice air injector, the damper box comprising front and rear faces with respective front and rear openings therein, a pair of sides, a top and a bottom; and a pair of gates pivotally mounted within the damper box and actuatable between open and closed positions.

14 Claims, 9 Drawing Sheets

ZERO COOLING AIR FLOW OVERFIRE AIR INJECTOR AND RELATED METHOD

This invention relates to fossil fuel boilers and more specifically to an improved overfire air injector for fossil fuel fired boilers.

BACKGROUND OF THE INVENTION

Overfire air (OFA) injection is a common technique for reducing NOx emissions from fossil fuel fired boilers equipped with reburn systems. An OFA system typically consists of overfire air injectors installed on the boiler walls; ductwork to route combustion air from the air supply to the injectors; and controls for modulating the overfire air flow rate. In many areas of the country NOx emissions control is a seasonal requirement, so that equipment must be designed with the understanding that it will be out of service for prolonged periods of time. For example, in a typical OFA injector, combustion air must be admitted to the injector when it is out of service in order to maintain the temperature of the injector components below the point at which they will be damaged by exposure to the radiant heat of the furnace. The cooling air flow results in operation of the burners at reduced stoichiometric ratios, and can lead to increased carbon loss and to furnace tubewall corrosion. The increased carbon loss and increased tubewall corrosion lead to increased operating costs and a significant loss of revenue.

The current solution to reduce the cooling air requirements is to design a water-cooled throat that provides conductive cooling to the OFA injector. This solution can reduce the cooling air flow as compared to a non-water-cooled throat design, but still results in OFA cooling flow rates that are in the range of 5–10% of the total combustion air.

There remains a need for a more effective way to protect OFA injectors with reduced use of combustion air as cooling air.

BRIEF DESCRIPTION OF THE INVENTION

This invention seeks to reduce the cooling air flow to below 5% when the OFA system is out of operation by shielding the OFA injector components from the radiant heat of the furnace. The OFA injector in accordance with an exemplary embodiment of the invention continues to utilize a water-cooled throat, but now includes a housing or damper box on the front end of the injector with actuated gates or doors that may be closed when desired to shield the injector hardware from the high temperature environment of the furnace. The OFA injector may have dual passages to extend the range of operation of the injector, but for some applications, only one passage may be required.

During normal operation, and when the OFA system is operating, the damper box doors are open. When the OFA system is not in operation, automatic actuators are used to close the doors and thereby shield the OFA injector. It is within the scope of the invention, however, to employ manual actuation if desired. The doors and interior surfaces of the damper box are also covered with refractory or other insulating material to provide additional protection from the high furnace gas temperatures.

Accordingly, in its broader aspects, the invention relates to a damper box for an orifice air injector, the damper box comprising front and rear faces with respective front and rear openings therein, a pair of sides, a top and a bottom; and a pair of gates pivotally mounted within the damper box and actuatable between open and closed positions.

In another aspect, the invention relates to a housing for an overfire air injector comprising a rearward portion adapted for connection to a supply duct and a forward portion having an attachment flange; a damper box secured to the attachment flange, the damper box having front and rear faces with respective front and rear openings therein, a pair of sides, a top and a bottom; and a pair of gates pivotally mounted within the damper box adjacent the front opening and actuatable to move the gates between open and closed positions.

In still another aspect, the invention relates to a method of shielding an overfire air injector in a fossil fuel fired boiler from heat during periods when the overfire air injector is not in use comprising: a) adding a damper box to a front end of a housing enclosing the overfire air injector, the damper box having a front opening and at least one gate actuatable between open and closed positions; and b) closing the front opening by moving the at least one gate to the closed position when the overfire air injector is not in use.

The invention will now be described in detail in connection with the drawing figures identified below.

DETAILED DESCRIPTION OF THE INVENTION

Figure 1:
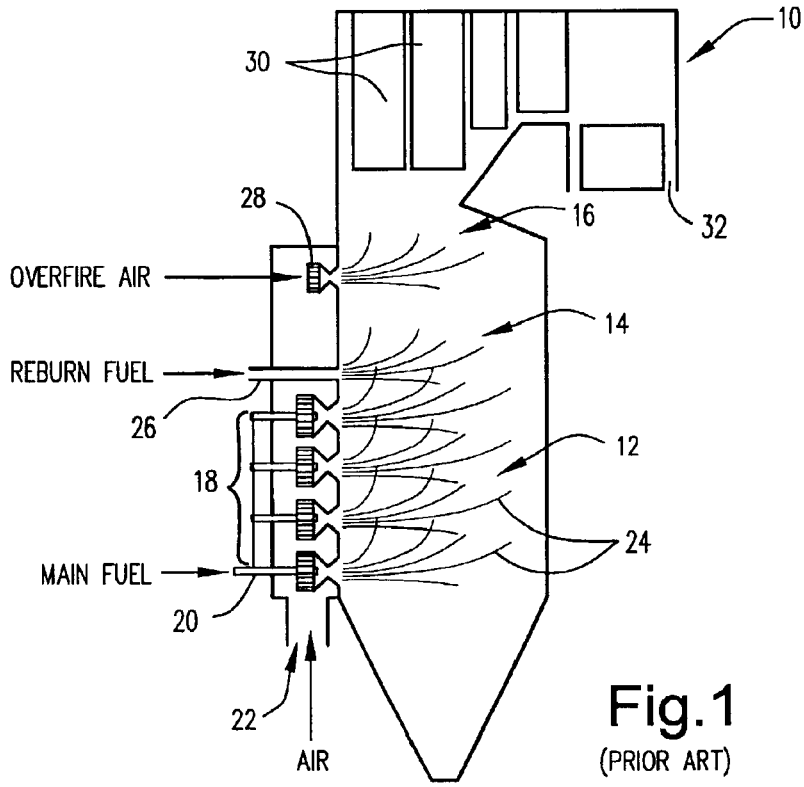
Fig.1 (PRIOR ART)
FIG. 1 is a schematic depiction of a conventional fossil fuel fired boiler.

FIG. 1 is a schematic depiction of a fossil fuel fired boiler 10 that includes a main combustion zone 12, a reburning zone 14, and a burnout zone 16. The combustion zone 12 is equipped with a plurality of main burners 18 which are supplied with a main fuel, such as coal and air, through a fuel input 20 and an air input 22, respectively. The main fuel is burned in burners 18 in the presence of air, to form a combustion flue gas 24 that flows in a downstream direction from combustion zone 12 to reburning zone 14. In some arrangements, about 85% of the total heat input can be supplied by main burners 18. The reburning fuel, such as natural gas, is injected through reburn fuel input 26 and provides the remaining heat input. Reburn fuel could also be any fossil fuel, i.e., coal, oil, orimulsion or propane gas. In burnout zone 16, overfire air is injected through an OFA injector 28 to complete combustion, and the flue gas then passes through a series of heat exchangers 30 and out of the boiler via outlet 32.

Figure 2:
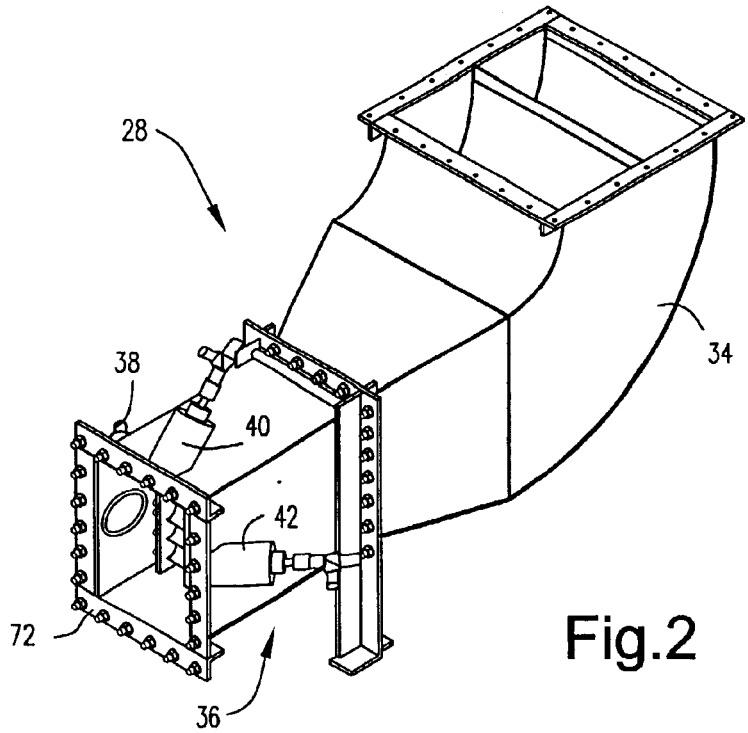
FIG. 2 is a perspective view of an overfire air injector in accordance with an exemplary embodiment of the invention.
Figure 3:
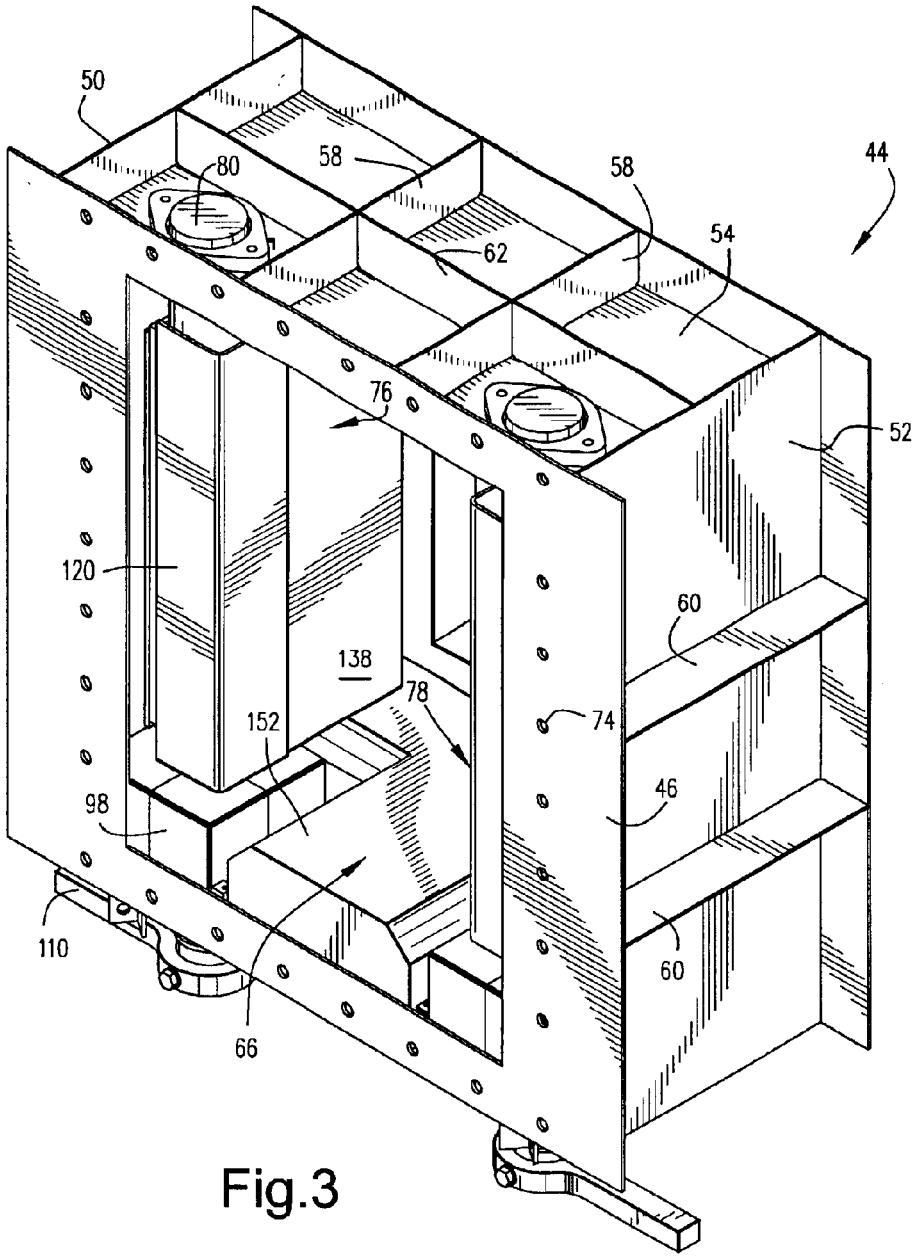
FIG. 3 is a perspective view of a damper box for use with the overfire air injector of FIG. 2.

FIG. 2 illustrates a new OFA injector 28 in more detail, useable in the conventional boiler 10. The assembly includes an elbow duct 34 that feeds the overfire air into a rectangular spool assembly housing 36. The housing 36 supports three aspirators 38, 40 and 42 on respective top and side walls of the housing. The internal injector hardware is not particularly relevant to this invention and, thus, no detailed description of that hardware is required. In addition, the upstream duct 34 as shown is exemplary only, and would have various cross-sectional shapes.

The present invention relates to a novel damper box construction to be added to the front face of the rectangular OFA injector housing 36 for protecting the OFA injector hardware when not in use.

With reference now to FIGS. 3–7, an overfire air injector damper box 44 in accordance with this invention is shown. The damper box 44 includes a flat front face 46, a flat rear face 48, sides 50, 52, top 54 and bottom 56. The sides 50, 52, top 54 and bottom 56 are reinforced by front-to-back webs 58, 60 and side-to-side webs 62, 64. Thus, the damper box 44 is a generally square, hollow structure with a front opening 66 and a rear opening 68. The rear opening 68 is surrounded by a rigid frame structure 70 utilized for mounting the damper box 44 to a similar frame 72 on the front face of the OFA injector 28 by means of holes 74 and bolts or other suitable fasteners.

Apertures 74 in the frame structure 70 facilitate attachment of the damper box to a wall of the boiler 10.

Within the damper box 44 are a pair of doors or gates 76, 78 located adjacent the front opening 66 and arranged to swing between open and closed positions vis-a-vis the front opening 66. Other gate arrangements may be utilized, including the use of a single gate or door where space permits. Since the doors are mirror images of each other, only one need be described in detail. With reference also to FIGS. 8–11, gate 76 is mounted on a hinge shaft 80 that is rotatably supported within the damper box. Specifically, the lower end of shaft 80 is journalled for rotation in a lower gland plate 82 fastened to the underside of the gate bottom 56 via fasteners 84. Gland plate 82 includes packing 86 that permits the shaft to rotate relative to the plate. Similarly, the upper end of shaft 80 is journalled for rotation in an upper gland plate 88 fastened to the top surface of gate top 54 via fasteners 90. The gland plate 88 is similar to plate 82 and also includes packing (not shown).

A pair of split, annular collars 94, 96 are located on the shaft 80 under the gate top 54 and above the gate bottom 56, respectively. Collar 96 is oversized and serves to isolate the shaft and lower gland plate 82 from dust. The lower collar 96 on the damper box bottom 56 is enclosed within a stainless steel cover 98.

Figure 10:
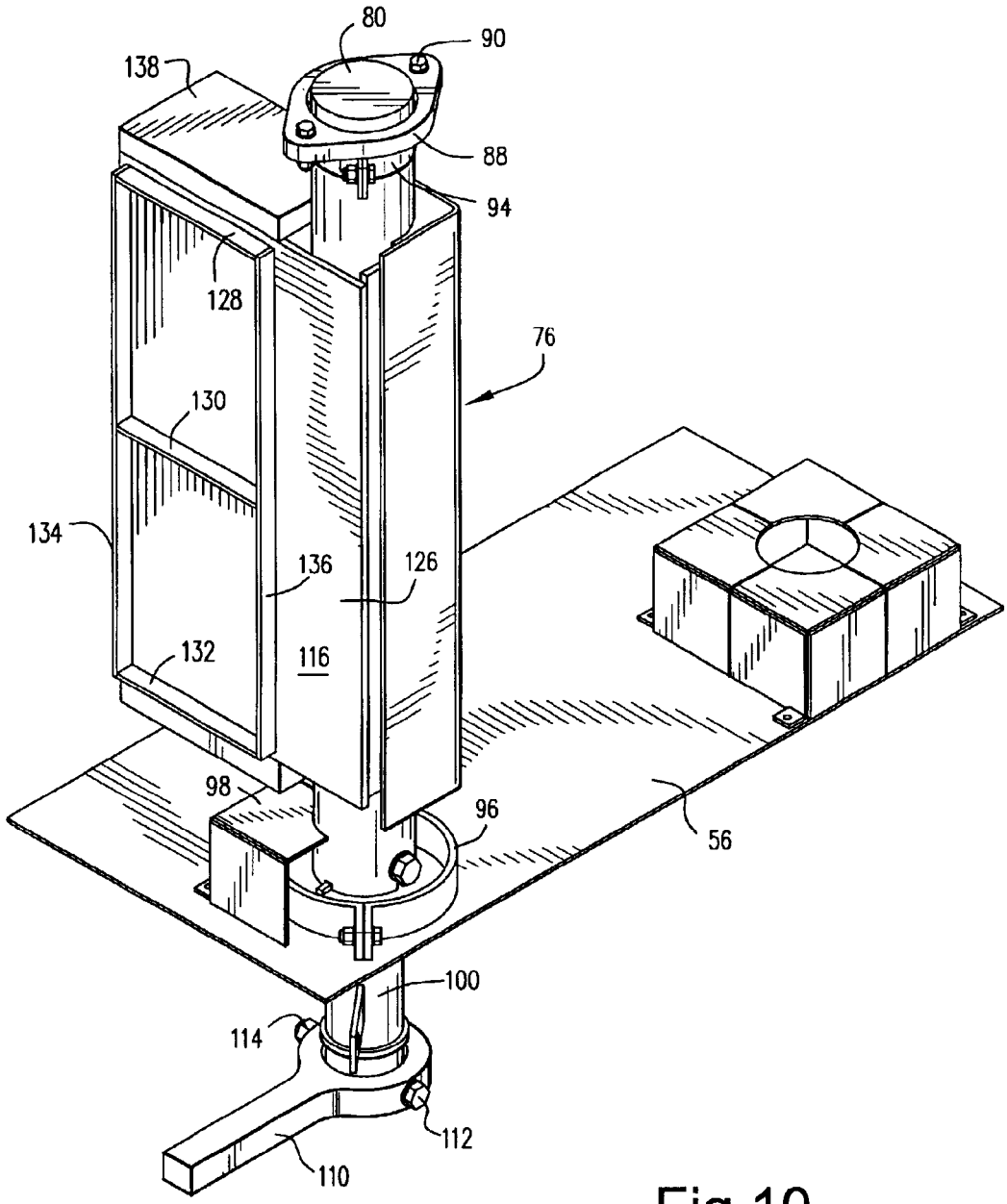
FIG. 10 is a perspective view of a damper gate of the type shown in FIGS. 1–7.
Figure 11:
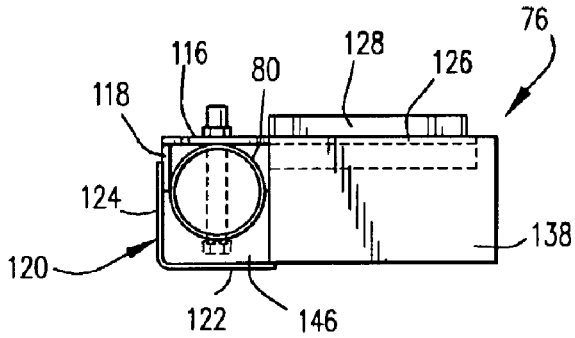
FIG. 11 is a plan view of the damper gate shown in FIG. 10.
Figure 12:
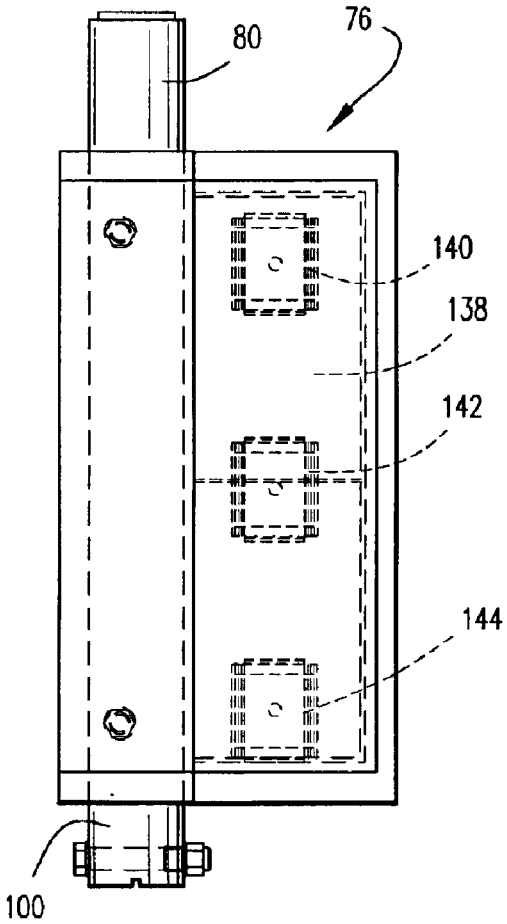
FIG. 12 is a side elevation of the damper gate shown in FIG. 10.
Figure 13:
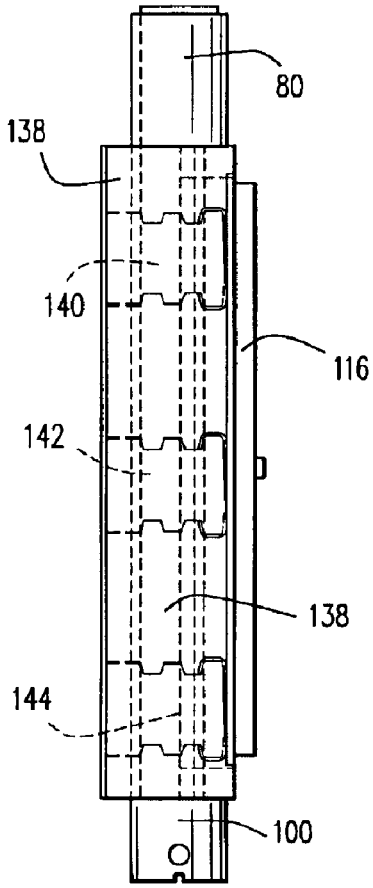
FIG. 13 is an end view of the damper gate shown in FIG. 12.

As best seen in FIGS. 10 and 11, a gate hinge handle shaft 100 is telescopingly received within the shaft 80 with a transverse pin 102 located within a slot 104 in the tubular shaft 100 to insure that shaft 80 will rotate with the handle shaft 100. A bolt 106 passes through the shafts 80, 100 and is secured by nut 108, just above collar 96 (within the cover 98) and serves to lock the shafts 100 to the shaft 80.

A gate hinge handle 110 is fastened to the lower end of handle shaft 100 via bolt 112 and nut 114. It will be appreciated that the handle 110 (and similar handle on the door 78) may be operated manually or operatively connected to suitable hydraulic, electrical and/or mechanical controls for automatically moving the doors 76, 78 to open the doors.

With reference also to FIGS. 10–14 the door 76 is constructed of a first plate 116 and a transverse edge plate 118 welded at the hinge end of the door. A corner plate 120 includes mutually perpendicular sides 122, 124, with side 124 welded to the edge plate 118 such that a portion of plate 116, edge plate 118, and sides 122, 124 of plate 120 surround three sides of the hinge shaft 80, with plate 116 extending further across the interior face of the door. The back side 126 of plate 116 is reinforced by a rectangular configuration of horizontal stiffening ribs 128, 130, 132 and vertical stiffening ribs 134, 136. A refractory block 138 is secured to the front side of plate 116 via refractory anchor clips 140, 142 and 144. A second refractory block 146 is secured behind the corner plate 120 about the front of the hinge shaft 80, and adjacent block 138.

Figure 4:
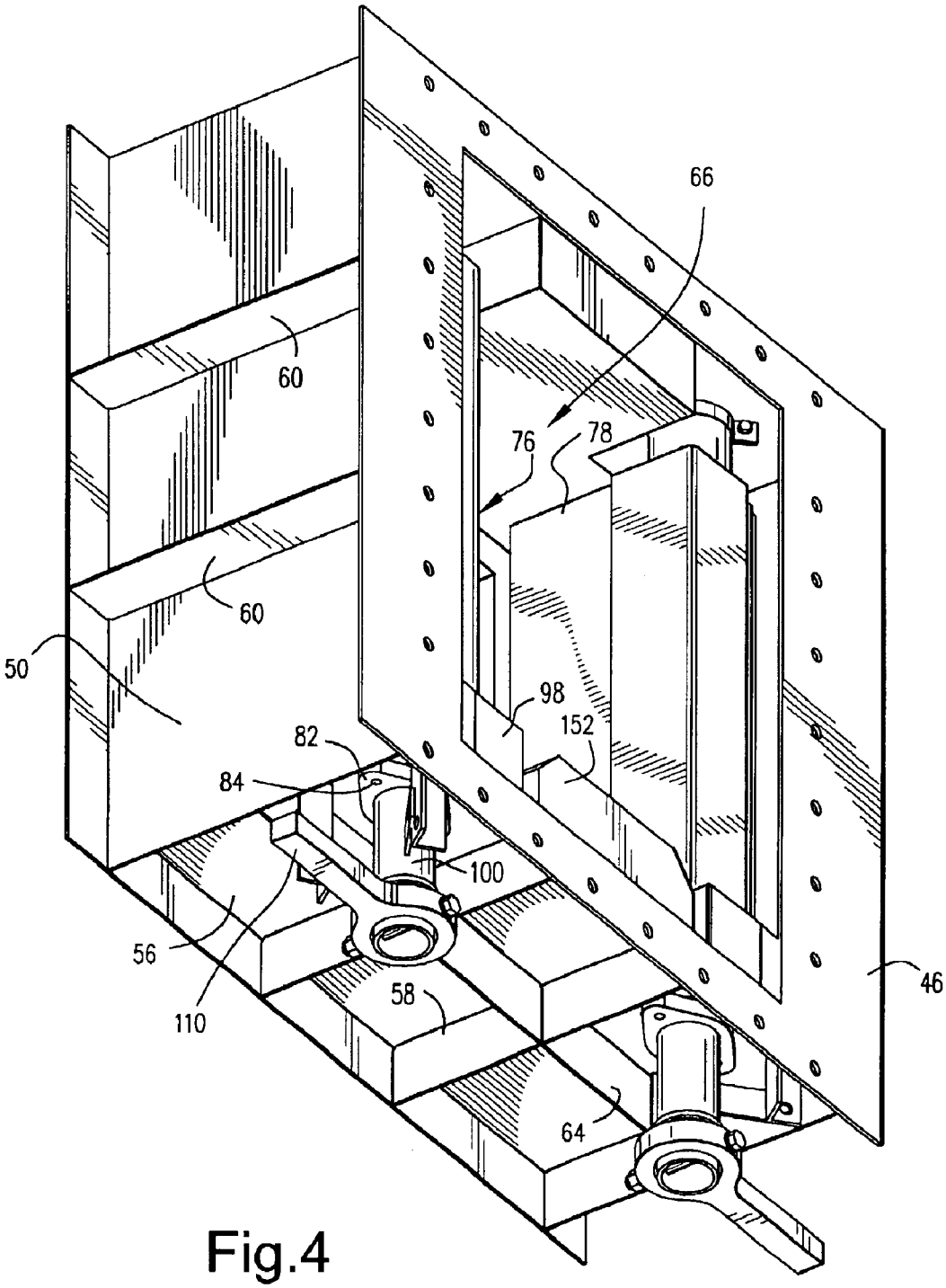
FIG. 4 is a lower left perspective view of the overfire air injector shown in FIG. 3.
Figure 5:
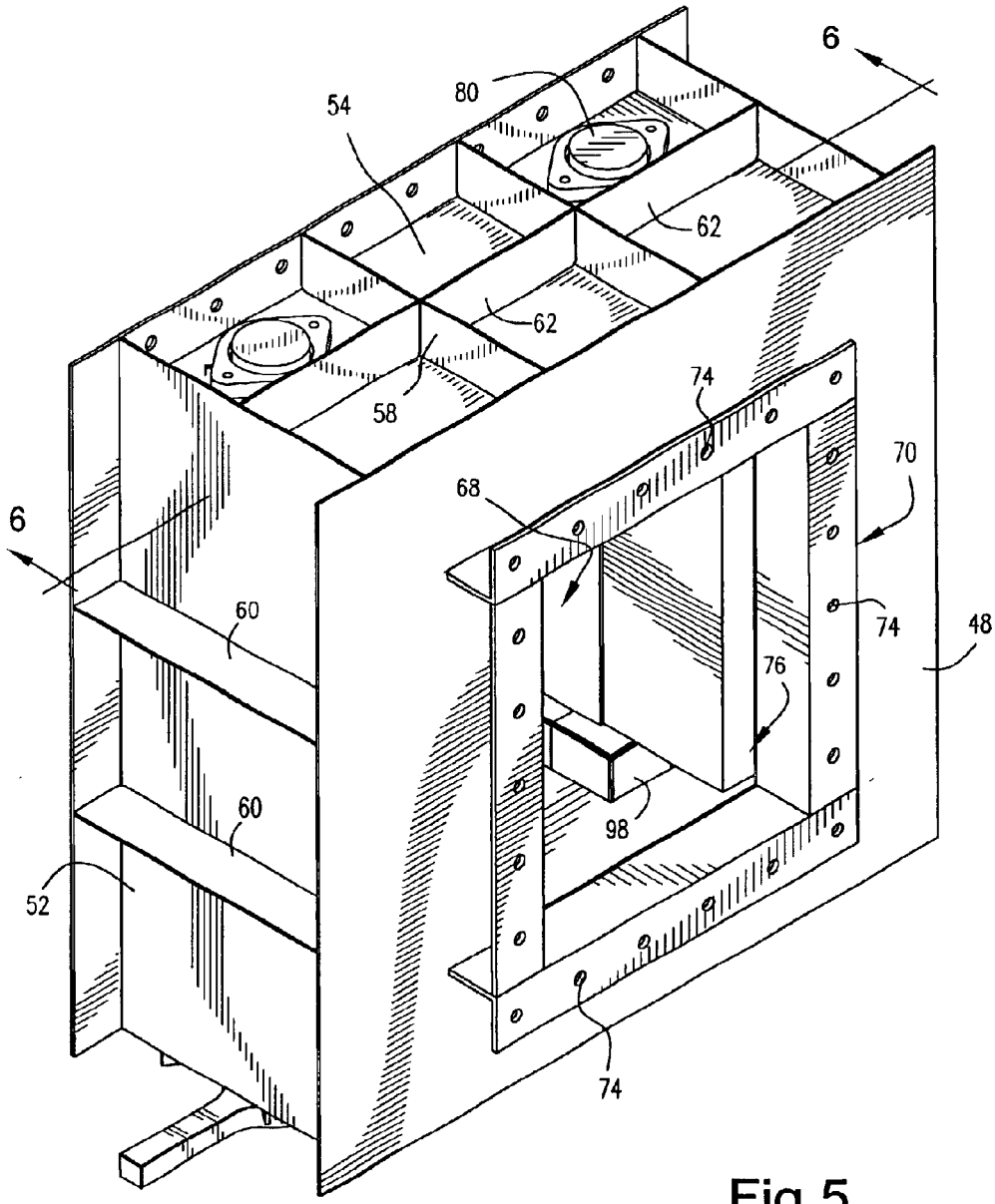
FIG. 5 is a rear perspective view of the overfire air injector of FIG. 2.
Figure 6:
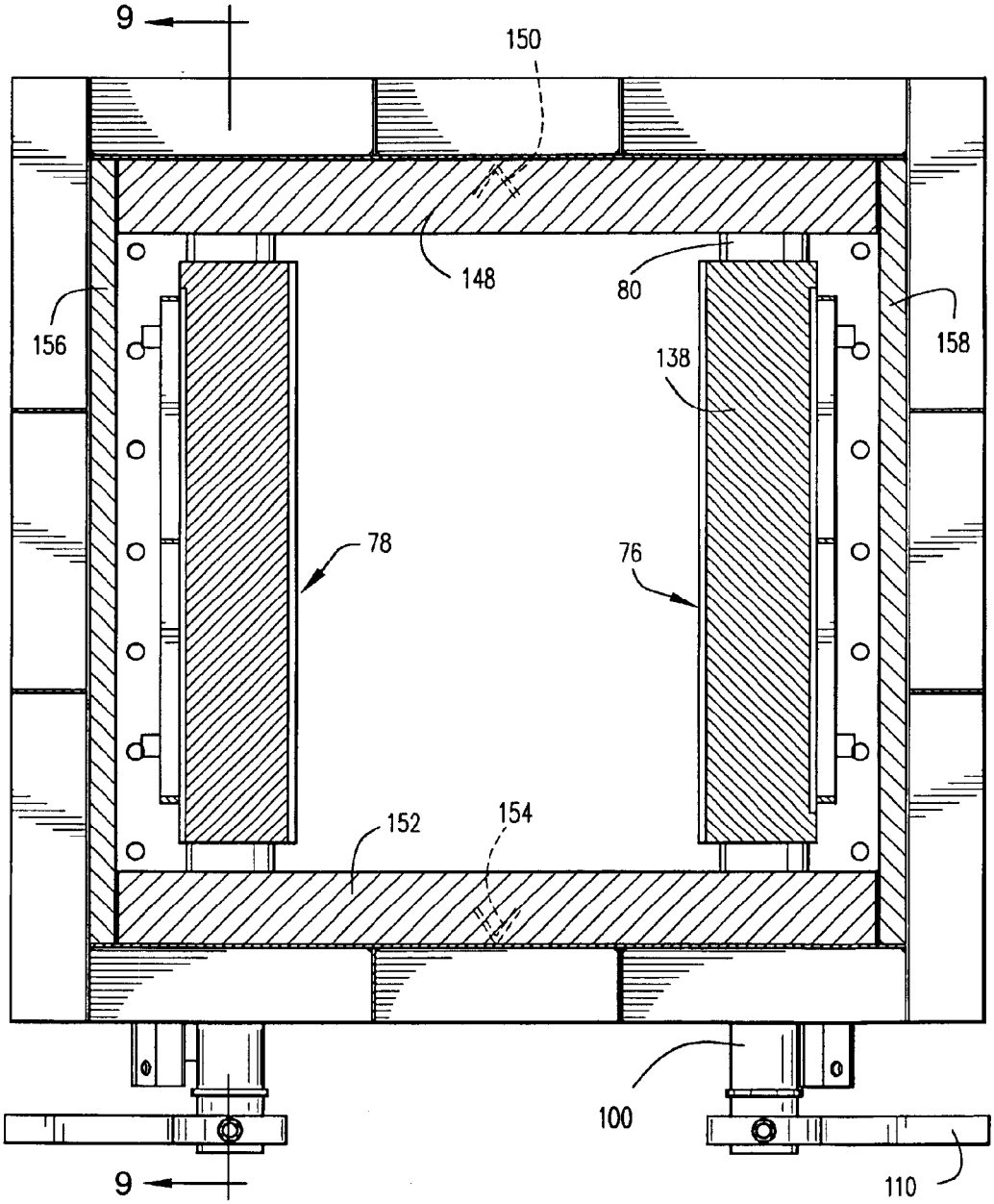
FIG. 6 is a section view taken along the line 6—6 of FIG. 5.
Figure 7:
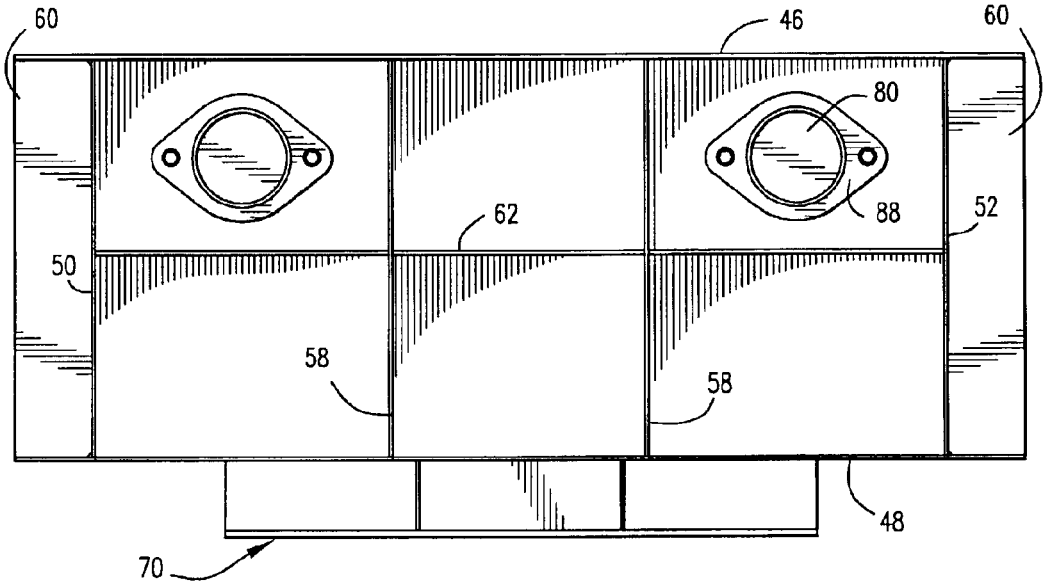
FIG. 7 is a top plan view of the overfire air injector shown in FIG. 5.
Figure 8:
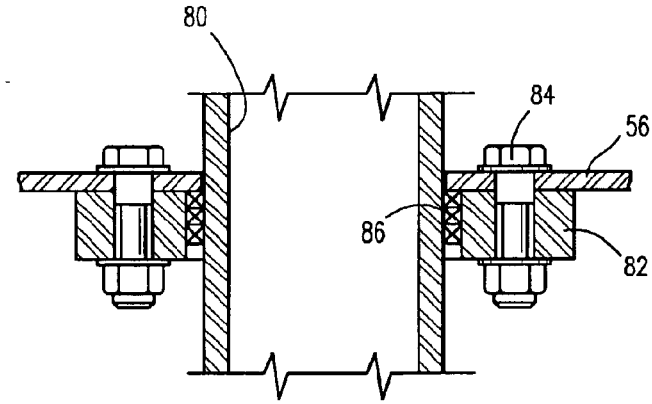
FIG. 8 is a section view of a gland plate surrounding a pivot shaft in the damper box in accordance with the exemplary embodiment of the invention.
Figure 9:
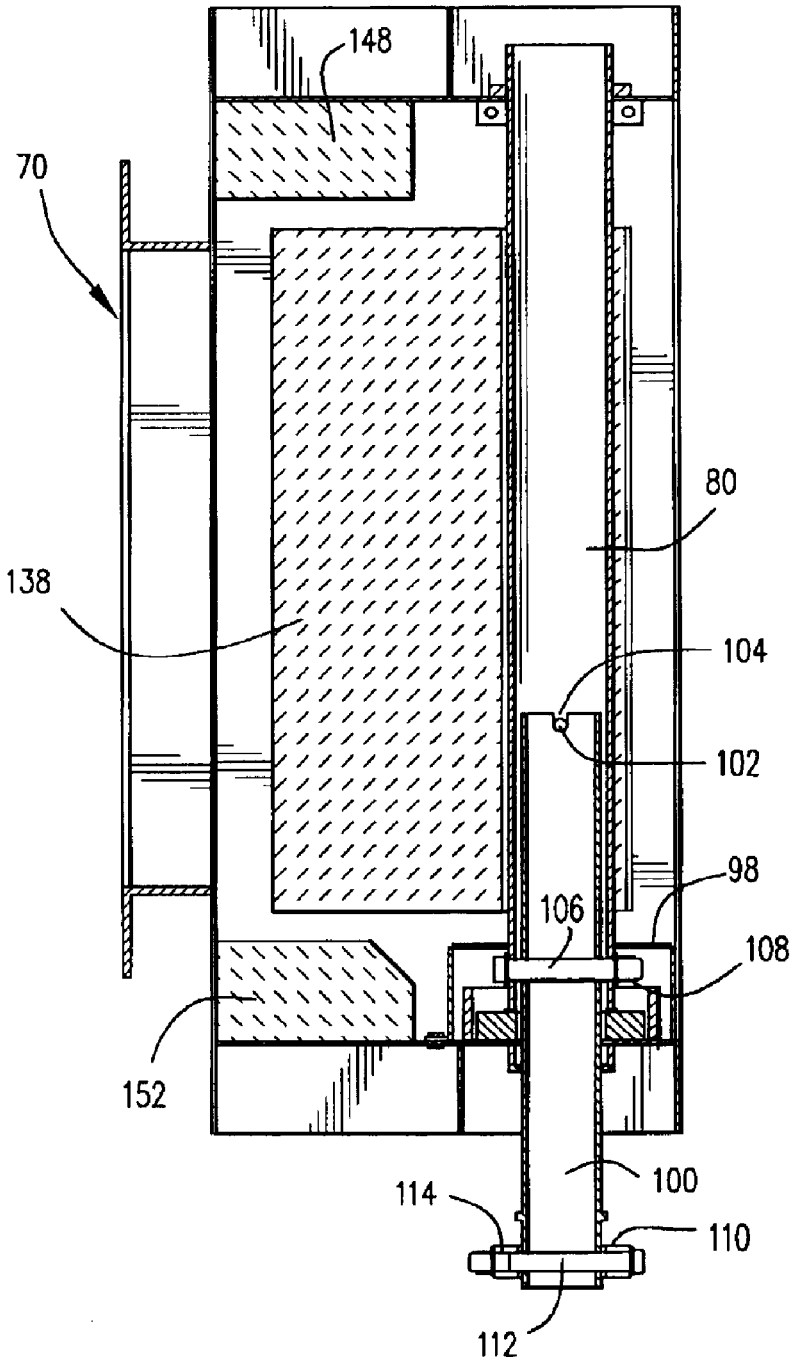
FIG. 9 is a section view taken along the line 9—9 of FIG. 6.

Similar refractory blocks are applied to the interior of the damper box as best seen in FIGS. 4, 7 and 10. Specifically, block 148 (FIG. 7) is applied to the underside of top 54 with the assistance of one or more refractory anchors 150. Refractory block 152 is applied to the interior side of bottom 56 via one or more anchors 154. The block 152 is cut out and beveled around the covers 98 as best seen in FIG. 4 to allow for door removal and installation without having to also remove the block 152. The refractory "blocks" noted above are preferably molded directly onto their respective supporting surfaces but other suitable application techniques may be employed.

Insulation board panels 156, 158 are applied to the interior surfaces of sides 50, 52.

Refractory blocks 138, 148 and 152 have a maximum service temperature of 3200° F., a density of 159 PCf @ 300° F., and a thermal conductivity of 11–43 (BTU-IN/HR—FT$^{2}$° F.). The refractory material is available under the trade name "Vesuvius Criterion 70 M." Block 146 has as maximum service temperature of 2300° F., a density of 61 PCf @ 300° F., and a thermal conductivity of 2.4 (BTU-IN/HR—FT$^{2}$° F.) and is available under the trade name "Vesuvius Litewate 58." Insulation board panels 156, 158 have a maximum service temperature of 2600° F. and a density of 25 PCf @ 3000° F. Other refractory block, insulation board and refractory material with similar insulating properties suitable for this application may be employed.

By enabling effective heat shielding of the OFA injector hardware when not in use, less than 5% combustion air is required to maintain the injector components at an acceptable temperature.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A damper box adapted for mounting on an outlet end of an overfire air injector in a boiler, said damper box comprising front and rear faces with respective front and rear openings therein, a pair of sides, a top and a bottom; and a pair of gates pivotally mounted within said front opening of said damper box for rotation about respective first and second parallel pivot shafts and actuatable between open and closed positions.

2. The damper box of claim 1 wherein said gates each include at least a first plate, a back side of which is lined with refractory material.

3. The damper box of claim 1 wherein internal surfaces of said pair of sides, top and bottom of said damper box are lined with refractory material.

4. The damper box of claim 2 wherein internal surfaces of said pair of sides, top and bottom of said damper box are lined with refractory material.

5. The damper box of claim 1 wherein first and second actuator handles are secured to said respective first and second pivot shafts.

6. The damper box of claim 5 wherein said first and second actuator handles are secured to respective first and second handle shafts that are secured to said respective first and second pivot shafts.

7. The damper box of claim 6 wherein said first and second handle shafts adapted for connection to automatic control apparatus.

8. A housing for an overfire air injector comprising a rearward portion adapted for connection to a supply duct and a forward portion having an attachment frame; a damper box secured to said attachment frame, said damper box having front and rear faces with respective front and rear openings therein, a pair of sides, a top and a bottom; and a pair of gates pivotally mounted within said damper box adjacent said front opening and actuatable to move said gates between open and closed positions.

9. The housing of claim 8 wherein said rear face of said damper box is secured to said attachment frame by a plurality of fasteners.

10. The housing of claim 8 wherein said gates each include at least a first plate, a back side of which is lined with refractory material.

11. The housing of claim 8 wherein internal surfaces of said pair of sides, top and bottom of said damper box are lined with refractory material.

12. The housing of claim 10 wherein internal surfaces of said pair of sides, top and bottom of said damper box are lined with refractory material.

13. The housing of claim 8 wherein said gates are pivotally mounted on respective first and second pivot shafts, and further wherein first and second actuator handles are secured to said respective first and second pivot shafts.

14. The housing of claim 13 wherein said first and second actuator handles are secured to respective first and second handle shafts that are secured to said respective first and second pivot shafts.

* * * * *